US006071181A

United States Patent [19]

Wightman et al.

[11] Patent Number: 6,071,181

[45] Date of Patent: Jun. 6, 2000

[54] KNIFE SHARPENING MACHINE

[75] Inventors: John Wightman, Manchester; Dennis Peth, Florissant; Walter J. Woehler, St. Peters; Jim Campbell, Festus; William Haack, St. Louis, all of Mo.

[73] Assignee: Edge Manufacturing, Inc., Pevely, Mo.

[21] Appl. No.: 09/130,752

[22] Filed: Aug. 7, 1998

[51] Int. Cl.[7] ..... B24B 3/54

[52] U.S. Cl. ..... 451/192; 451/65; 451/349

[58] Field of Search ..... 451/191, 192, 451/193, 196, 198, 202, 203, 206, 208, 45, 65, 349

[56] References Cited

U.S. PATENT DOCUMENTS

| | | | |
|---|---|---|---|
| 1,734,524 | 11/1929 | Kohlmiller | 451/203 |
| 2,228,385 | 1/1941 | Burns . | |
| 2,482,633 | 9/1949 | Nichols . | |
| 2,617,235 | 11/1952 | Lindahl | 451/192 |
| 2,768,476 | 10/1956 | Jerome et al. | 451/192 |
| 2,865,141 | 12/1958 | Madl et al. . | |
| 3,484,997 | 12/1969 | Allen . | |
| 4,052,174 | 10/1977 | Grat | 451/196 |
| 4,265,055 | 5/1981 | Cartwright et al. . | |
| 4,807,399 | 2/1989 | Friel . | |
| 5,005,319 | 4/1991 | Friel . | |
| 5,245,789 | 9/1993 | Rees et al. | 451/198 |

FOREIGN PATENT DOCUMENTS

| | | | |
|---|---|---|---|
| 472175 | 5/1914 | France | 451/202 |
| 289311 | 4/1928 | United Kingdom | 451/192 |

OTHER PUBLICATIONS

Cozzini Inc. "PrimEdge" Machine literature.

*Primary Examiner*—Robert A. Rose
*Attorney, Agent, or Firm*—Polster, Lieder, Woodruff & Lucchesi, L.C.

[57] ABSTRACT

A knife sharpening machine has sharpening and honing assemblies each having fixed and movable subassemblies with circular stones mounted on shafts, the stones being spaced from one another. An adjusting mechanism moves the movable subassemblies toward and away from the fixed subassemblies, from a position at which the stones interleave to one at which they are substantially tangent to one another. The movable subassemblies each includes a yoke in a free end of which the stone-carrying shaft is journaled for rotation. The yoke is pivoted on an axis of rotation. One gear is mounted on the axis of rotation of the yoke co-axially with the axis, driving a gear on the shaft of the subassembly carried by the yoke. A motor and gears of gear trains intermediate a pinion on the motor and the pivot gear are mounted on a plate mounted on a cast base/housing supporting the yoke. Sharpening and honing assemblies are both mounted on the one base/housing, and both are driven, at different speeds of rotation, through gear trains, by the same motor.

18 Claims, 6 Drawing Sheets

KNIFE SHARPENING MACHINE

BACKGROUND OF THE INVENTION

Knife sharpening machines have been the subjects of a great many patents. A patent to Burns, U.S. Pat. No. 2,228,385 discloses a pair of motor driven sharpening stone assemblies, each made up of a plurality of spaced circular sharpening stones mounted on arms that can be moved around a pivot point coincident with the axis of a motor shaft, to vary the angle of intersection of the overlapped peripheries of the grinding elements. The machine of Burns is belt driven. Lindhal U.S. Pat. No. 2,617,235 shows a hand cranked sharpening device, in which a gear, driven by the crank, engages pivot gears mounted on arms that are biased continuously by a spring toward one another, so that sharpening disks carried by the arms are always in engagement, even when they wear. In such an arrangement, a knife being sharpened tends to move the sharpening disks away from one another, so that, depending upon the amount of pressure applied to the knife, the angle of the cutting edge and the amount of abrasion will vary. Nichols, U.S. Pat. No. 2,482,633 discloses a motor driven sharpening unit, with a pulley from a motor to a sheave to drive one of two idler gears, the other of which is mounted on a pivot point of a yoke which can be moved about that pivot point by a knurled knob, to move grinding wheels on a shaft carried by the yoke toward and away from grinding wheels carried on a shaft fixed against translation. Two of the grinding wheels meet face to face, so that the amount of the adjustment permitted is limited to compensation for wear of the abutting grinding wheels. A patent to Allan, U.S. Pat. No. 3,484,997 discloses a motor driven knife sharpener, in which a gear on the motor shaft drives mediately a gear mounted on a pivot axis of an arm which carries at its upper end a gear mounted on a shaft driving abrasive disks mounted on the shaft, so as to maintain a desired overlap of the abrasive disk as the diameter of the disks is reduced by wear. Friel U.S. Pat. No. 4,807,399 discloses a machine with a pre-sharpening section and two honing sections. Both the honing stones and the sharpening stones are driven by a single motor. A sharpening machine sold under the trademark PrimEdge, by Cozzini Inc., also has honing and sharpening wheels driven by a single motor, through belts.

Among the objects of this invention are to provide a commercial or industrial knife sharpener that is sturdy, economical to manufacturer, dependable, easily maintained, and readily adjustable to produce different edge angles.

Other objects will become apparent to those skilled in the art in light of the following description and drawings.

BRIEF SUMMARY OF THE INVENTION

In accordance with this invention, generally stated, a knife sharpening and honing machine is provided, with a base/housing, (or, simply, housing) which carries on an outside surface a sharpening stone assembly and a honing stone assembly, each with a fixed subassembly having a shaft journaled for rotation on the housing, fixed against translation. A second sharpening stone subassembly and a second honing stone subassembly are carried by yokes pivoted to the outside surface of the housing so as to be movable toward and away from the sharpening and honing stone fixed subassemblies.

The base/housing is hollow and open-bottomed. It also has an open mouth in a side of the housing opposite the sharpening and honing stone assemblies. The bottom and the open mouth of the housing are closed by a heavy gauge steel plate, which serves as a closure for the bottom and open mouth of the housing, and, on its mouth-covering vertical part, carries, on its inside face, an electric motor and on its outside face, a gear train culminating in a gear that meshes with a gear mounted on a pivot axis of a yoke, and a gear on the shaft of the sharpening stone subassembly and the shaft of the honing stone subassembly that is fixed against translation. The pivot gear on both subassemblies meshes with an idler gear carried by the yoke, the idler gear meshing in turn with the gear mounted on the shaft of the movable subassembly. The provision of a single plate with the motor and gear trains mounted on it provides for a simple modular construction, permitting the gear trains or motor or both to be removed for repair or replacement. For example, to accommodate a 220 volt 50 Hertz motor of the type commonly used outside the United States, which runs about 11% slower than the standard U.S. 110 volt 60 Hertz motor, it is only necessary to bolt the motor to the plate, and to replace gears of the gear train, which requires only the addition of three holes in the plate.

The stone assemblies are of the interleaving type, and are moved into interleaving position by a rod with a knob at one end, and a threaded section at an opposite end, the threaded section being received in an internally threaded passage in a pier formed as part of the housing casting, and the rod passing through a passage in the yoke large enough to permit pivoting movement of the yoke with respect to the rod. A compression spring is positioned between the pier with the threaded hole in it and the yoke. A stop, on the opposite side of the yoke, can be in the form of an E ring or shaft collar mounted in an annular channel in the rod. The stop holds the yoke positively against movement away from the fixed subassembly with which it is associated. In this way, the movable subassemblies are spring biased in a direction away from the fixed subassemblies and are positively constrained against movement away from the fixed assembly beyond what has been deliberately set.

The adjusting rod arrangement makes adjustment of the assemblies quick and easy, from a position at which the stones are tangent to one another to a position at which the stones define between them a relatively wider angle. The provision of the mounting plate makes assembly of the device and its repair easy. Because legs of the yoke are long compared with the amount of travel required of the free end of the yoke, the movement of the moveable subassemblies is practically linear.

The speed of rotation of the honing stone assemblies is low relative to the speed of the sharpening stone assemblies. This is accomplished by reducing gears, mounted on the mounting plate.

DETAILED DESCRIPTION OF THE INVENTION

Figure 2:
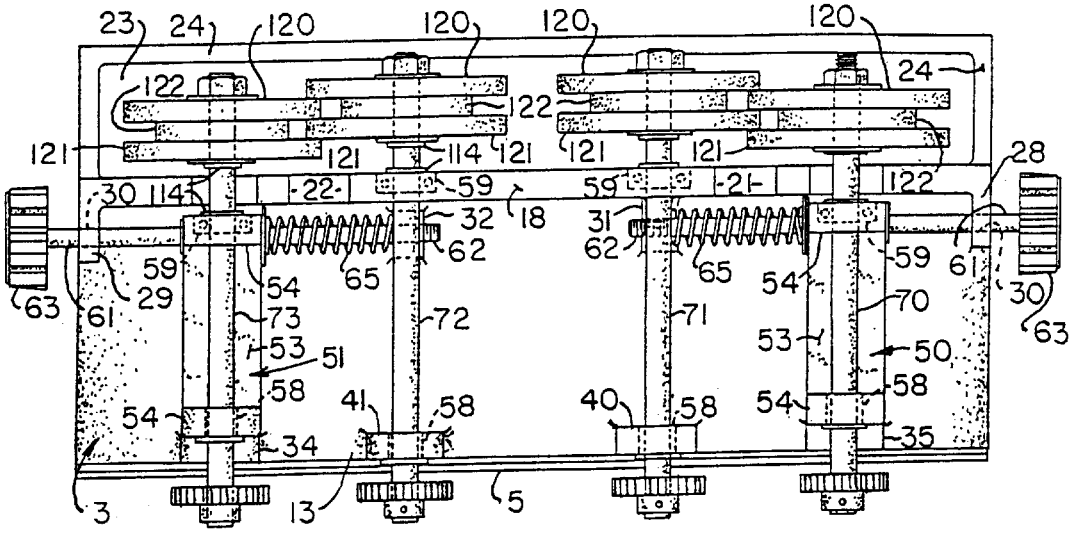
FIG. 2 is a top plan view of the machine shown in FIG. 1 with a cover removed.
Figure 3:
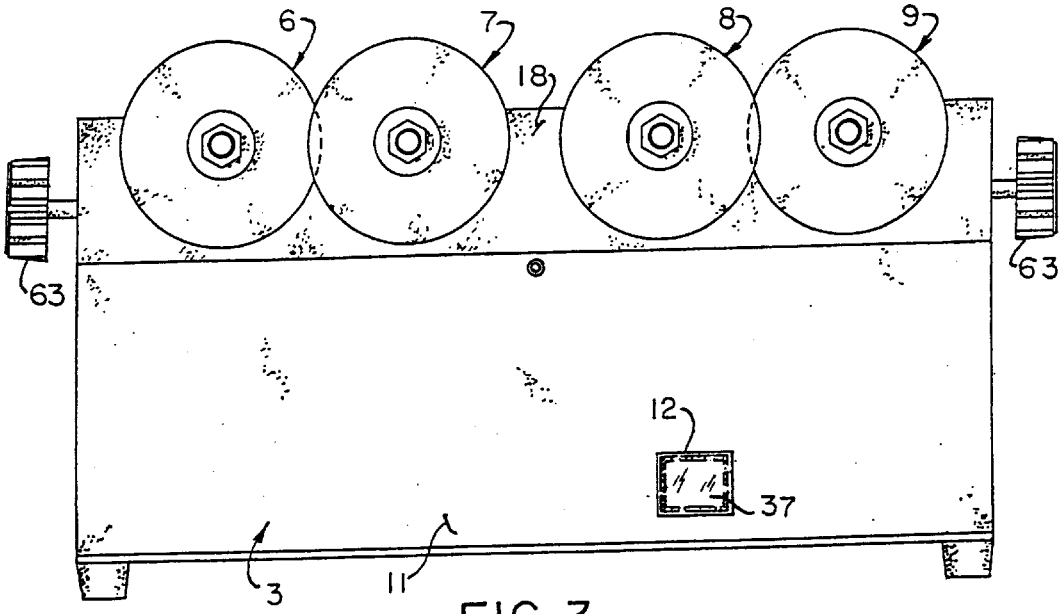
FIG. 3 is a view in front elevation of the device shown in FIG. 2.
Figure 5:
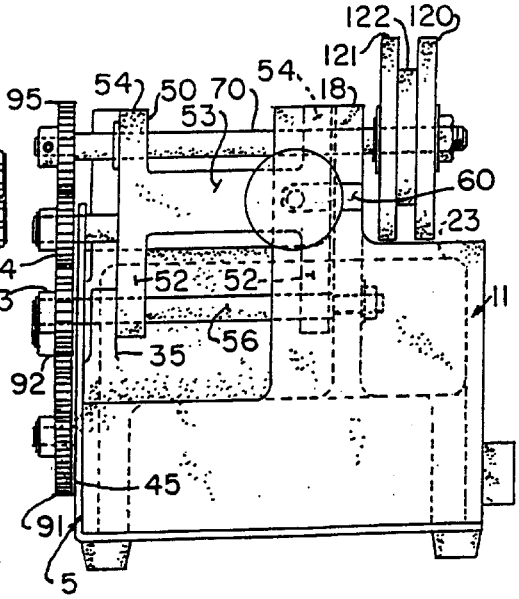
FIG. 5 is an end view, viewed from right to left of FIG. 4.

Referring now to the drawings for one illustrative embodiment of knife sharpening machine of this invention, reference numeral 1 indicates the completed machine, enclosed in a two part cover 2. The machine itself has a base/housing (or, simply, housing) 3, supported on feet 4. The base/housing 3 has a top wall 13, end walls 14, a front wall 11, and a back wall 15, together defining a cavity 16 with an open mouth 17 through the back wall 15. The top wall 13 slopes from its center downwardly toward both end walls. The front wall 11 is uninterrupted except for a passage forming a seat 12 for an on/off switch 37. As shown in FIGS. 2, 3 and 5, the front wall 11 ends at its top in a straight horizontal line, and extends above the top wall 13 a short distance in the center and a substantial distance at the ends, to form a pan, useful in collecting water if the sharpening wheels are sprayed, although wetting or spraying apparatus does not form a part of this invention, such apparatus being conventional.

Figure 4:
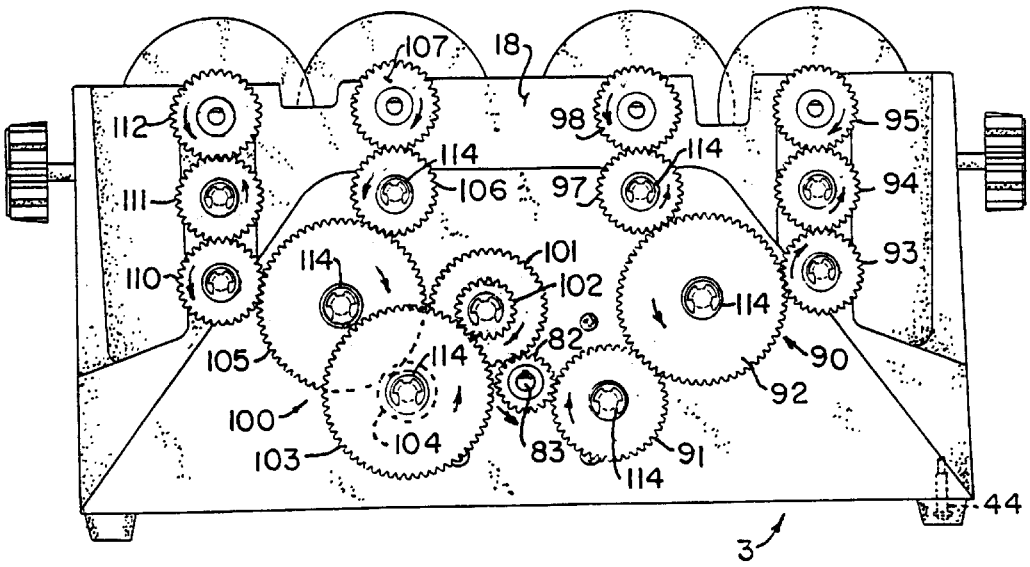
FIG. 4 is a view in rear elevation.
Figure 9:
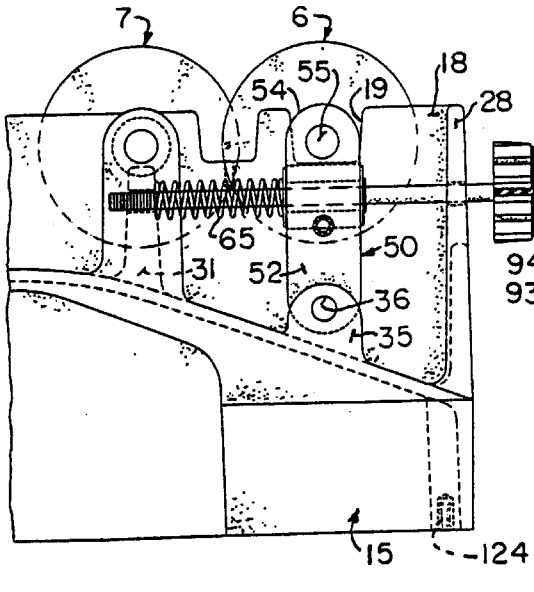
FIG. 9 is a fragmentary view in rear elevation of FIG. 6 with the gears removed, better to illustrate the adjusting mechanism.
Figure 6:
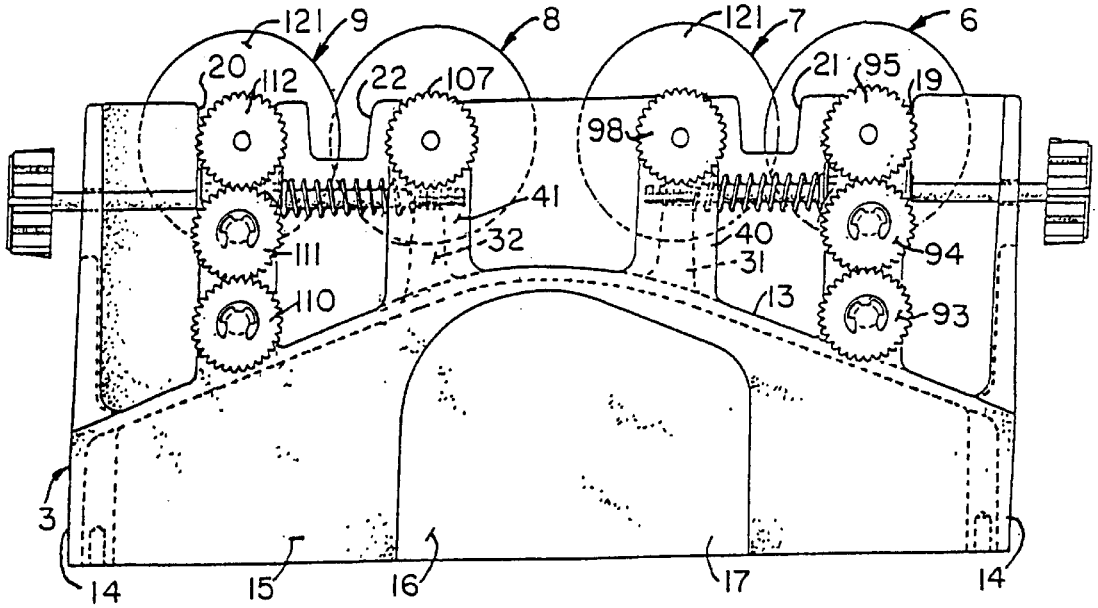
FIG. 6 is a view in rear elevation of the device of FIG. 4, with a mounting plate and its gear elements removed.

A supporting wall 18, offset rearwardly from the front wall 11 and forming a rear wall for the pan 23, is crenelated, with assembly adjustment gaps 19 and 20 and knife accommodating gaps 21 and 22, as shown particularly in FIGS. 4, 6 and 9.

The machine has a sharpening stone assembly made up of a movable stone subassembly 6, and a fixed stone subassembly 7, and a honing stone assembly made up of a fixed honing stone subassembly 8 and a moveable honing stone subassembly 9. Abrading elements of the subassemblies 6 and 7 are mounted on shafts 70 and 71 respectively, with drive gears 95 and 98 respectively secured to an end of the shafts remote from the abrading elements of subassemblies 6 and 7. The abrading elements of subassemblies 6 and 7 are staggered with respect to one another, the abrading elements of subassembly 7 being positioned farther forwardly than those of the subassembly 6. Each of the abrading elements is made up of relatively thin front stones 120 and rear stones 121, with a spacer 122 between them. The spacer and the stones can be made in one piece or separately. In any event, the spacer provides a gap between the stones 120 and 122 which permits the interleaving of the stones, as shown in FIG. 2.

In the illustrative embodiment shown, corner walls 28 and 29, each with a through passage 30, piers 31 and 32, stanchions 40 and 41, and ears 34 and 35 are cast as a piece with the top wall 13 of the housing. The honing subassemblies 8 and 9, and their shafts and gears 72 and 73 and 107 and 112 respectively, are mirror images of the sharpening subassemblies 6 and 7. The honing stones are generally of a finer grit than the sharpening stones, but can be substantially identical in dimension as shown in the drawings, although they can have different dimensions, depending upon the particular application. The subassemblies 7 and 8 are fixed against translation, their shafts 71 and 72 passing through passages in the supporting wall 18, where they are journaled in roller bearings 59, and bushings or sleeve bearings 58 in stanchions 40 and 41.

The subassemblies 6 and 9 are mounted for translation with respect to the fixed subassemblies 7 and 8. Their shafts 70 and 73, respectively, are mounted in bearings 58 and 59 carried by bosses 54, parts of yokes 50 and 51. The yokes 50 and 51 have legs 52, pivotally mounted on a pivot shaft 56. The pivot shaft 56 is fixedly mounted at one end in the supporting wall 18, and supported at its rearward end in a pivot shaft through-passage 36 in pivot ears 34 and 35, respectively. The shaft 56 does not move.

The yokes 50 and 51 have a heavy bridging piece 53 extending between the legs 52, below the bosses 54. The bridging pieces 53 have in them slots 60 through which threaded adjusting rods 61 extend. The adjusting rods 61 have at an outer end a knob 63, and at an inner end, a threaded section 62, which threadedly engages internal threads in a passage in one of the piers 31 and 32. A compression spring 65 abuts a face of one of the piers 31 and 32 at one end and the bridging piece 53 at another end, continually biasing the pivoted yoke 50 or 51 away from the fixed pier 31 or 32. Each of the adjusting rods 61 has an annular groove in which a spring washer is mounted to restrain the yoke 50 or 51 positively against movement away from the spring 65, which is to say, to hold the moving stone subassembly 6 or 9 positively against displacement in a direction away from the corresponding fixed subassembly. Because the travel of the yoke is limited by the configuration of the subassemblies themselves, and because the subassemblies are mounted in such a way as to be at the apex of the arc, and because the effective length of the legs 52 between the pivot axis and the axis of rotation of the assemblies is long compared with the distance of travel, for example, 2½ inches v. ½ inch, the movement of the movable assemblies is practically linear. To the extent that the movement is not linear, the passage 60 is of a dimension to accommodate the small arc of the yoke with respect to the rod 61.

Gears 98 and 107 are mounted on shafts 71 and 72 respectively of subassemblies 7 and 8. Gears 95 and 112 are mounted on shafts 70 and 73 respectively of the subassemblies 6 and 9. Meshing with gears 95 and 112 are idler gears 94 and 111, with which gears 93 and 110 mesh. Gears 94 and 111 are mounted on stub shafts fixed in rear surfaces of legs 52 of yokes 50 and 51 respectively. Gears 93 and 110, which mesh with gears 94 and 111 respectively, are mounted for rotation on pivot shafts 56 so that their axes of rotation are coincident with the axes of the shafts 56, hence with the pivot axes of the yokes 50 and 51.

Figure 1:
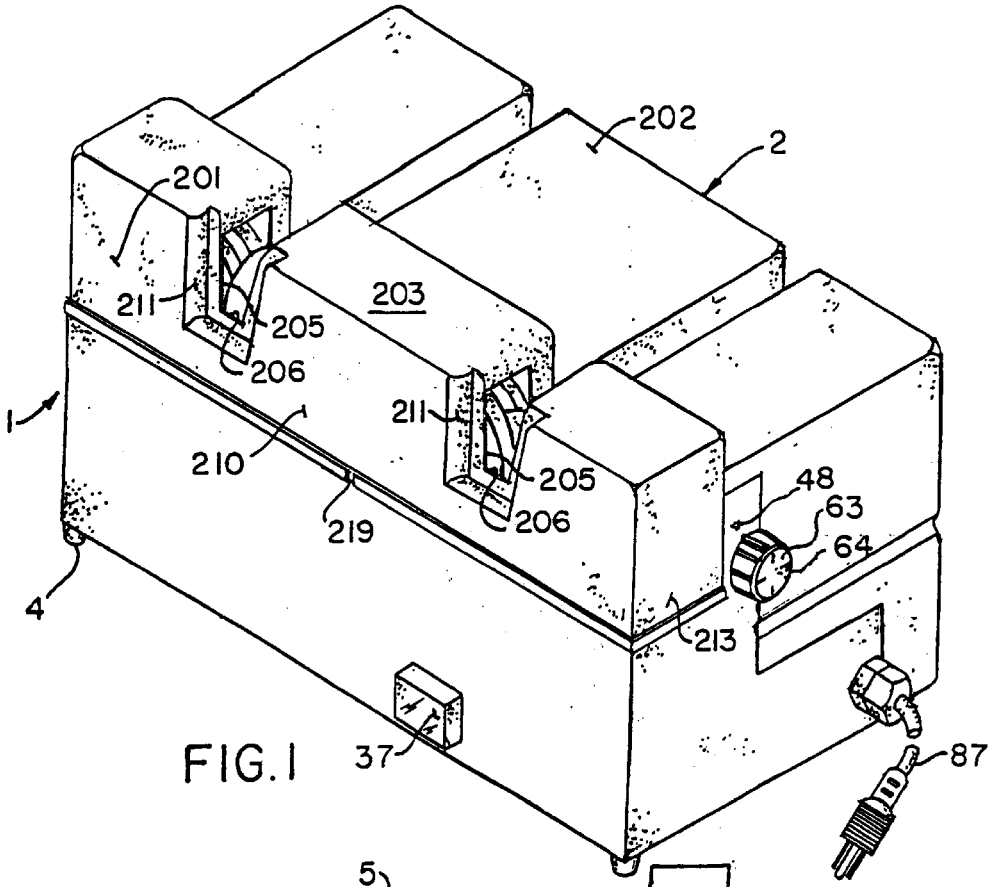
FIG. 1 is a view in perspective of one embodiment of knife sharpening machine of this invention, with sharpening and horning stones shown somewhat schematically, and an electric cord and plug shown fragmentarily.
Figure 8:
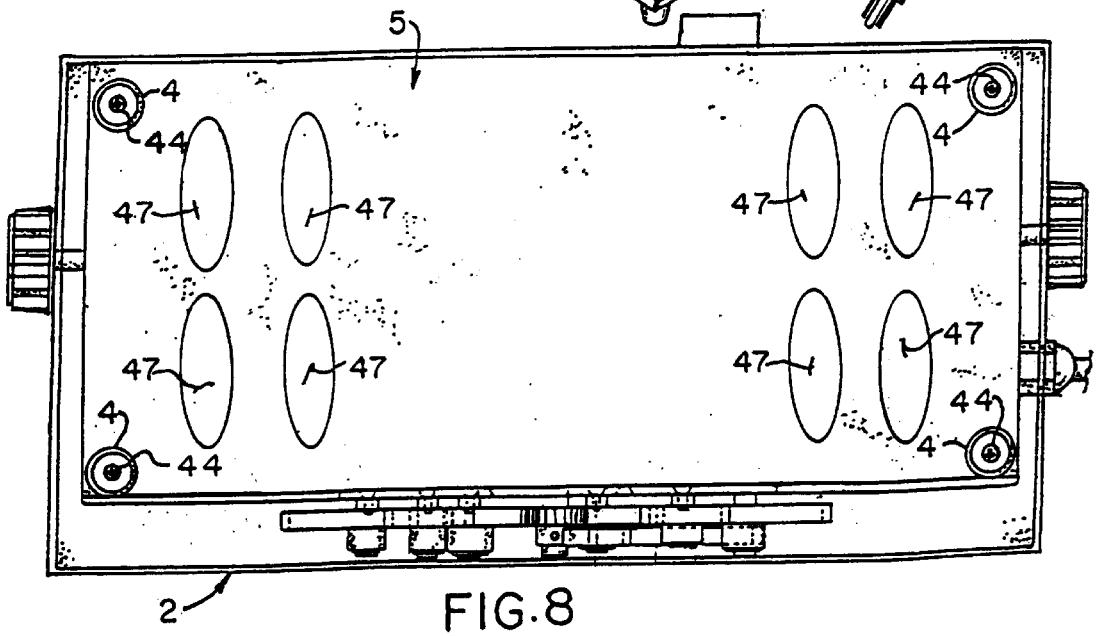
FIG. 8 is a bottom plan view of the device shown in FIG. 1.

A plate 5, L-shaped in end elevation, has a bottom panel 46 that serves as a base/housing bottom closure, and a back panel 45. The bottom panel 46 has in it vents 47. The back panel 45 not only serves as a closure for the mouth 17 of the cavity 16, but also as a mounting support for a motor 84, which is mounted to the inboard surface of the panel 45 by means of screws 85, and for idler gears 91, 92 and 97, forming a gear train 90, driving the gears 93 and 98, and for first idler gear 101 which carries reducing gear 102, second idler gear 103, carrying reducing gear 104, and third idler gear 105, which meshes with and drives the yoke pivot gear 110 and also a plate mounted idler gear 106, which drives the gear 107. The gears 101, 102 103, 104, 105, and 106 make up a second gear train 100. A drive gear or pinion 82, mounted on a motor shaft 83 of the motor 84, meshes with idler gears 101 and 91, to drive both gear trains 90 and 100. All of the gears 91, 92, 97, 101 and 102, 103 and 104, 105 and 106, are mounted on stub shafts secured to the back panel 45 of the plate 5. The plate 5 is secured to the housing 3 by means of screws 44, which also serve to attach the feet 4, the screws 44 screwing into internally threaded bushings in bosses cast in the housing, as indicated in FIGS. 4, 8 and 9.

Figure 7:
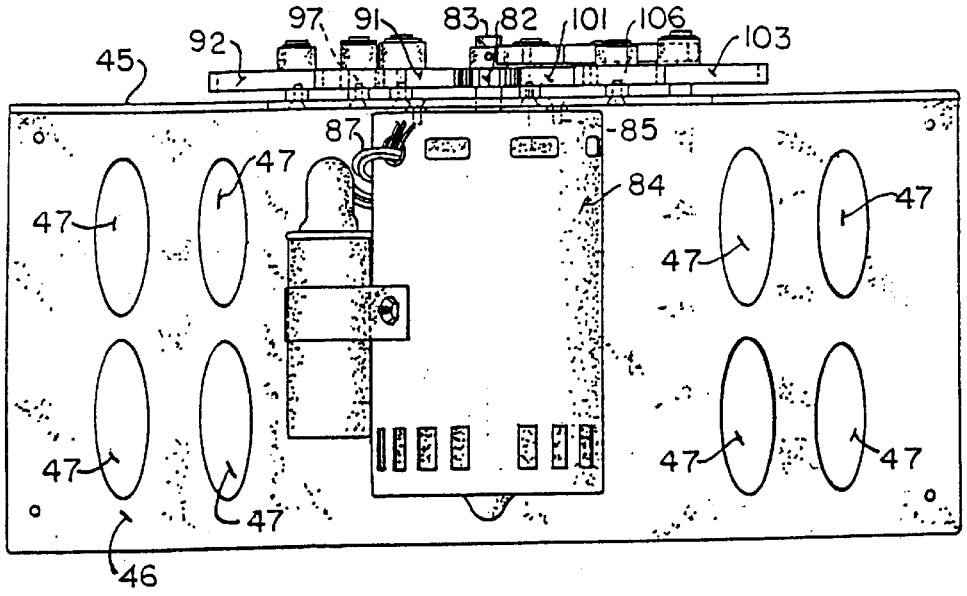
FIG. 7 is a top plan view of the mounting plate, showing a motor and gear trains mounted on the plate.
Figure 10:
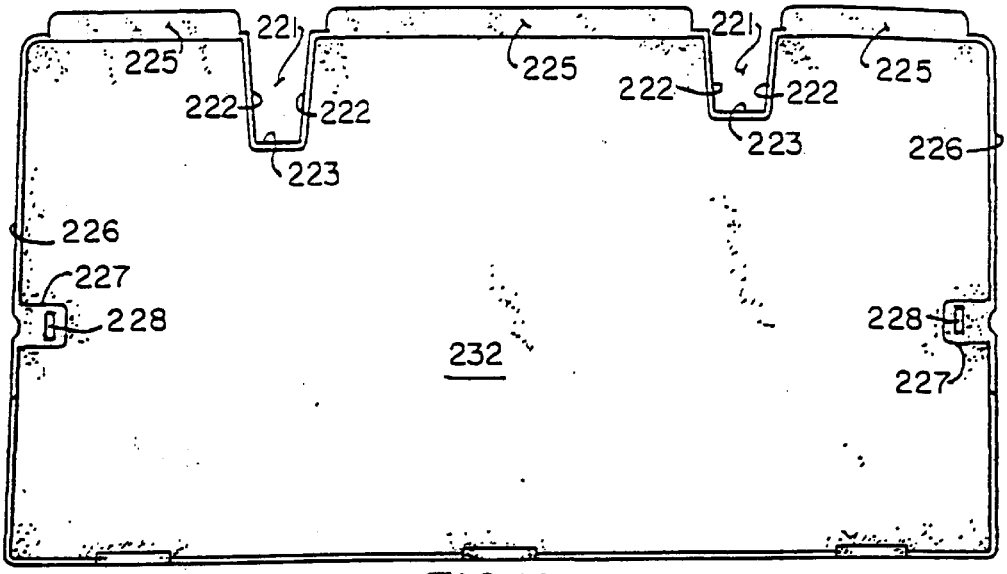
FIG. 10 is a view in rear elevation of one of two sections of cover.
Figure 11:
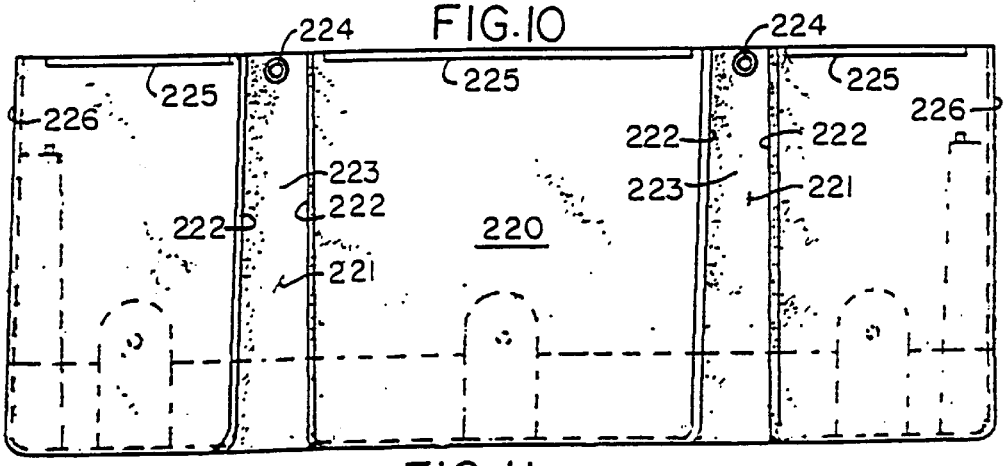
FIG. 11 is a top plan view of the cover section shown in FIG. 10.
Figure 12:
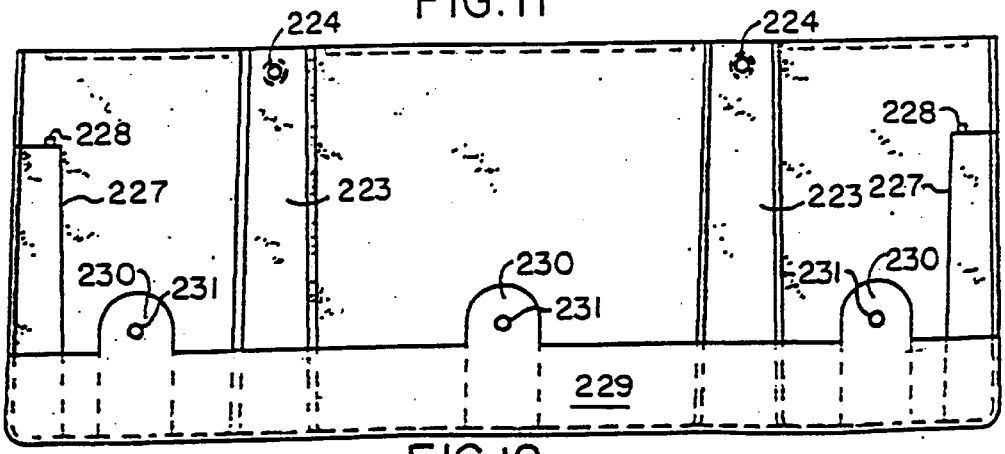
FIG. 12 is a bottom plan view of the cover section shown in FIGS. 10 and 11.
Figure 14:
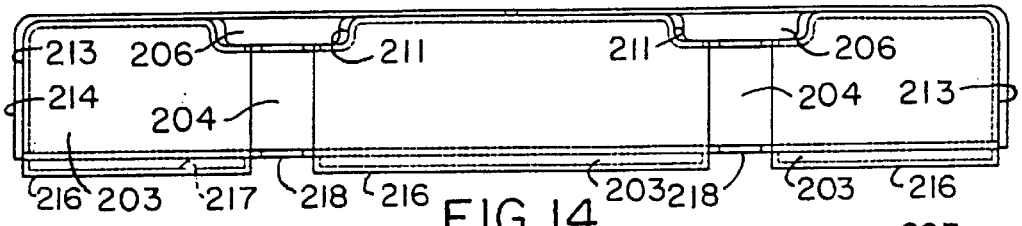
FIG. 14 is a top plan view of the other section of the cover.
Figure 15:
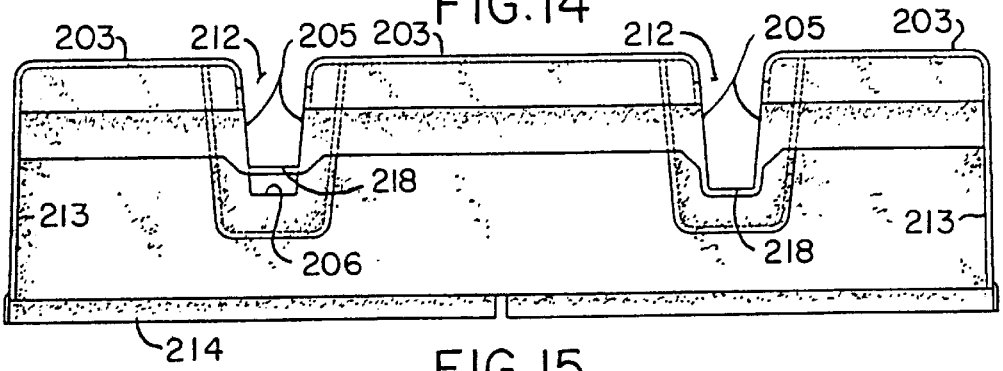
FIG. 15 is a bottom plan view of the section shown in FIG. 14.
Figure 16:
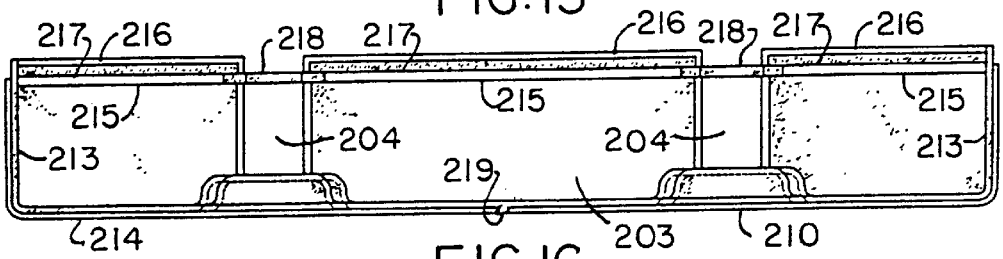
FIG. 16 is a bottom plan view of the section shown in FIGS. 14 and 15.
Figure 13:
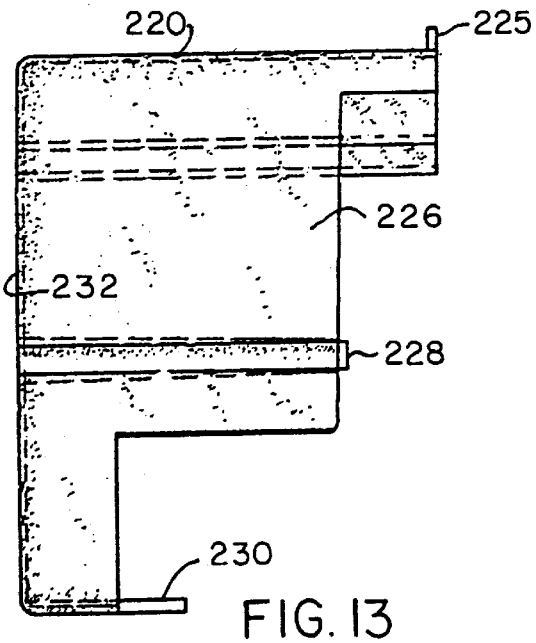
FIG. 13 is a view in side elevation of the cover section shown in FIG. 12.
Figure 17:
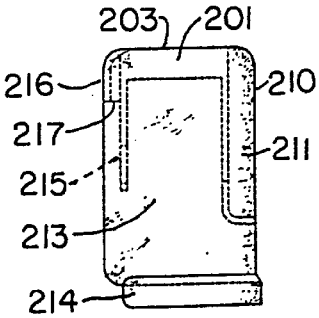
FIG. 17 is a view in side elevation of the section of cover shown in FIGS. 14–16.

As seen particularly in FIGS. 4, 6 and 7, the gear trains 90 and 100 are carried entirely by the plate, as is the motor 84. This makes assembly of the gear trains and motor simple, and easy to repair if that becomes necessary, and makes it economical to change gear ratios or otherwise to modify the gear trains, because only the plate need be changed, not the entire base/housing.

As can be seen from FIG. 4, for example, the honing stones will be driven at a much slower rate of rotation than the sharpening stones. Merely by way of example, the sharpening stones can be rotated at 1170 RPM and the honing stones, at 195 RPM. At that rate, if the stones are three inches in diameter, the surface feed per minute of the sharpening stones will be 919 feet and the honing stones, 153 feet per minute. As the stones wear, the rate of surface feed will decrease to some extent.

As can be seen, a single motor drives both the sharpening and the honing assemblies positively through gears, at different speeds, in a way that permits movement of the moveable subassembly of stones toward and away from the fixed, stationary subassembly of stones. The pivot gears 93 and 110 remain fixed with respect to their driving gears 92 and 105 respectively, regardless of the position of the stones relative to one another. As will be evident from FIG. 4, the intermediate idler gears 94 and 111 serve to reverse the rotation of the stones of the movable subassemblies with respect to the rotation of the stones of the fixed subassemblies. In the illustrative embodiment shown, stones 7 and 9 are rotated clockwise as viewed in FIG. 3, and stones 6 and 8, counterclockwise. If different directions of rotation are desired, the direction of rotation of the motor can be reversed, or the gearing changed.

In use, it is preferable to back the sharpening and honing stones subassemblies 6 and 9 away from the fixed subassemblies 7 and 8 until the stones are tangent to one another, and then to move the subassemblies 6 and 9 toward the subassemblies 7 and 8 respectively a predetermined number of turns of the knobs 63 to produce the desired knife edge angle. Of course, the angle of sharpening can and should be different from the angle of honing. In any event, by moving the subassemblies a given number of turns of the adjusting rod from their tangential position, the number of turns being easily determined by reference to a pointer 48 on the casting and indicia 64 on the knob, the knife edge angle can be set for any desired degree. For example, with a ¼", 20 pitch threaded adjusting rod, an included angle of sharpening of approximately 45 degrees can be obtained by rotating the rod four revolutions, or 28 degrees by rotating the rod two revolutions from the tangential position of the stones.

In the embodiment of knife sharpener and honer described above, the cover is made in two sections, a stones cover section 201 and a base/housing cover section 202. The stones cover section 201 has a top 203, with slots 204 in it to define three bays, a front wall 210, in which a screw-receiving notch 219 extends from a lower edge, and a side wall 213. The front wall has integral with it recessed, knife admitting front frames 211, with open topped passages 212 defined by upwardly divergent side walls 205 and a bottom wall 206. A skirt 214 extends along the length of the front wall 210 and through most of the length of the side walls 213, to define a step that rests on top surfaces of the front wall 11 and end walls 14 of the machine. A rear wall, interrupted by the passages 212, depends from the top 203, inboard of the rear edge of the top, which continues far enough to space an overhanging wall or ledge, similarly interrupted, extending parallel to the rear wall to define pockets 217. Rear frames 218, corresponding in shape to the recessed front frames 211 and aligned with them, are integral with the rear wall 215.

The base cover section 202 has a top wall 220, in which channels 221 are formed, defined by divergent side walls 222, a rear wall 232, which covers the gears of the machine, and a bottom wall 223, in which screw holes 224 are provided. The channels 221 are aligned with and complement the front and rear frames 211 and 218 of the stones cover section, to accommodate a knife blade. Tongues 225, projecting upwardly from the front edge of the top wall 220 between the channels 221, fit into the pockets 217 of the stones cover section 201, to hold the section 201 in place. The base cover section 202 has side walls 226, on an inside surface of which rails 227 extend generally parallel with the top wall 220. Tabs 228 project from free ends of rails 227 and extend into complementary notches, not here shown, in the end walls 14. A short bottom wall 229 has ears 230 extending from its free edge. The ears 230 have screw holes 231 in them, through which screws extend into complementarily positioned screw-receiving holes in the bottom 46. In securing the cover 2 to the body of the sharpener, the base/housing cover section 202 is slipped on from the back, and screws driven through the holes 231. Screws are then driven through the holes 224 in the bottom walls of the channels 221, into screw-receiving holes in the supporting wall 18, to hold the section 202 securely. The stones cover section is then dropped into place, with the tongues 225 extending into the pockets 217, and a knurled set screw, threaded into a tapped hole in the front wall 11, is tightened. When access to the stones is desired, it is only necessary to loosen the set screw and lift the stones cover section off.

Numerous variations in the construction of the sharpener of this invention within the scope of the appended claims will occur to those skilled in the art in the light of the foregoing disclosure. Merely by way of example, the base/housing can be differently fabricated, although casting it in one piece is simple because of its shape, and permits the use of aluminum as well as iron, and even reinforced plastic. The illustrative base/housing is approximately 6" deep, 8" high and 13" long, but those dimensions can be varied. The gears of the illustrative embodiment are Acetal, the idler gears being mounted on fixed shafts on ball or roller bearings, held against axial movement by E-rings, but other gears or bearings can be used. The adjusting rod can be threaded into a threaded passage in the corner wall and butt with its end against the yoke instead of passing through the yoke, although this would require different provision for the spring which biases the yoke continuously toward the stop element of the adjusting rod, whether the stop element be an E-ring or the blunt end of the rod itself. The provision of a constant bias of the yoke toward and against the adjusting rod stop eliminates play in the assemblies, so as to ensure a fixed, uniform knife edge angle. Other biasing means can be used, as a helical tension spring between the corner wall and the yoke, or a leaf spring of sorts. Different gear arrangements can be used, to cause the assemblies to rotate in the same direction, if that is desired. The yoke can be differently configured, or made solid, with long through-holes or even, at its lower end, with stub shafts as pivot shafts. Although in the embodiment shown, the cover is made of tough, durable plastic, it can be made of metal, and can be fastened in other ways. These variations are merely illustrative.

What is claimed is:

1. A knife sharpening machine comprising a housing, a stone assembly, carried by said housing, comprising a fixed subassembly, and a movable subassembly, each of said subassemblies having circular stones mounted on a shaft, spaced axially from one another, the axial space between the circular stones of each assembly being sufficient to admit one of the circular stones making up the other assembly, said assemblies being axially offset from one another to permit interleaving of said stones, adjusting means for moving said movable subassembly toward and away from said fixed subassembly, from a position at which they are tangent to one another to a position at which they are interleaved, means for rotating said subassemblies including a gear mounted at an end of each subassembly shaft remote from said stones carried by said subassembly, the shaft of the movable subassembly being mounted in a free end of a yoke pivotally mounted on said housing on an axis of rotation, and a gear mounted on said axis of rotation of said yoke, coaxially with said axis and operatively connected with said gear on said movable subassembly shaft, said adjusting means comprising an adjusting rod for selectively rocking said yoke around said axis of rotation to move one assembly toward and away from the other assembly, and a motor for driving said gears.

2. The machine of claim 1 wherein said adjusting rod has a stop element bearing on said yoke, and means for continuously biasing said yoke against said stop element.

3. The machine of claim 2 wherein said biasing means is a compression spring mounted on said adjusting rod.

4. The machine of claim 1 wherein the circular stones are sharpening stones.

5. The machine of claim 1 wherein the circular stones are honing stones.

6. The machine of claim 1 having two stone assemblies, one carrying sharpening stones, the other, carrying honing stones.

7. The machine of claim 6, wherein said motor has a shaft on which a pinion is mounted, and gear trains for transmitting rotary force between said pinion and the gears mounted on said circular stone-carrying shafts, said gear trains including an intermediate gear large in diameter as compared with the gears on the shafts on which the circular stones are mounted, said intermediate gear being operatively connected to be driven by said motor and meshing with gears rotatably mounted between said intermediate gear and said circular stone carrying gears, one of said gear trains having one more gear intermediate said intermediate gear and one of said circular stone gears, whereby said circular stones are rotated in opposite directions.

8. The machine of claim 7 wherein one of the circular stones turns clockwise and the other, counter-clockwise away from one another as viewed from the top.

9. A knife-sharpening machine comprising two stone assemblies, one carrying sharpening stones, the other, honing stones, each of said stone assemblies comprising two subassemblies each having circular stones mounted on a shaft, spaced axially from one another, the space between the circular stones of each subassembly being sufficient to admit one of the circular stones making up the other subassembly, one of each of said subassemblies being fixed, the other, movable, adjusting means for moving said moveable subassemblies toward and away from said fixed subassemblies, from a position at which the stones interleave to one at which they are tangent to one another, and means for rotating said moveable subassemblies a predetermined distance toward or away from said fixed assemblies including a yoke in a free end of which one of said shafts is journaled for rotation, gears mounted on said circular stone carrying shafts, a base on which said yoke is pivotly mounted on an axis of rotation, intermeshing gears mounted on said yoke, and a gear mounted on said axis of rotation of said yoke, coaxially with said axis and meshing with a gear on said yoke, means for selectively rocking said yoke around said axis of rotation to move one subassembly toward and away from the other subassembly, and a motor with a shaft on which a gear is mounted for driving the gears of both the sharpening stones and the honing stones.

10. A knife sharpening machine comprising a sharpening stone assembly made up of a movable subassembly and a fixed subassembly, and a honing stone assembly made up of a movable subassembly and a fixed subassembly, and a single motor driving both assemblies, at different speeds, through gear trains wherein said assemblies are supported by a hollow housing having an open mouth in a back wall and said motor and a multiplicity of gears of said gear trains are mounted on a plate extending along said back wall, said motor being mounted to extend from an inside surface of said plate into said housing, and said gears being mounted to extend from and along an outside surface of said plate.

11. The knife sharpening machine of claim 10 wherein said housing is open bottomed, and said plate is L-shaped in end elevation, with a back panel on which said motor and gears are mounted and which serves as a closure for said mouth and a base panel that serves as a closure for the open bottom of said housing.

12. A knife sharpening machine comprising a sharpening stone assembly made up of a movable subassembly and a fixed subassembly, a honing stone assembly made up of a movable subassembly and a fixed subassembly, and a single motor driving both assemblies, at different speeds, through gear trains; means for holding each movable subassembly positively in a selected position against movement away from its adjacent fixed subassembly, and means for continuously biasing said movable subassembly in a direction away from said fixed subassembly.

13. The knife sharpening machine of claim 10 wherein said movable subassemblies are mounted for rotation in a yoke pivotally mounted on said housing, and means for moving said movable subassembly toward and away from said fixed subassembly comprises a fixed pier on said base/housing having a threaded passage in it, an adjusting rod having a threaded end threaded into said threaded passage and a knob on another end, said rod extending through a passage in said yoke, and a stop element carried by said rod for positively engaging said yoke to move said yoke when the rod moves longitudinally in response to screwing of said rod into said pier passage and to hold said yoke positively in place when said rod is screwed out of said pier passage.

14. The knife sharpening machine of claim 13 including biasing means for continuously biasing said yoke in a direction away from said fixed assembly, said biasing means comprising a compression spring mounted on said adjusting rod between said pier and said yoke.

15. The knife sharpening machine of claim 1 wherein said housing comprises a one-piece casting and a steel, L-shaped plate, said motor being mounted on a broad surface of said plate.

16. The knife sharpening machine of claim 13 wherein the knob and said housing each has at least one reference indicium by which the number of revolutions or partial revolutions of the threaded adjusting rod can be gauged to get a predetermined degree of sharpening angle.

17. The knife sharpening machine of claim 10, including a cover made up of two sections, a stones cover section and a housing cover section, said housing cover section being mounted on said housing, and said stones cover section being readily removably mounted on said housing cover section.

18. The knife sharpening machine of claim 12 wherein the means for holding each movable subassembly positively comprises a threaded adjusting rod revolvably threaded through a fixed member, said rod having a knob at one end, and at least one reference indicium associated with said knob by which the number of revolutions or partial revolutions of the threaded adjusting rod can be gauged to get a predetermined degree of sharpening angle.

* * * * *